US010912329B2

(12) United States Patent
Apetrei Birza

(10) Patent No.: US 10,912,329 B2
(45) Date of Patent: Feb. 9, 2021

(54) AEROSOL-GENERATING SYSTEM AND CAPSULE FOR USE IN AN AEROSOL-GENERATING SYSTEM

(71) Applicant: PHILIP MORRIS PRODUCTS S.A., Neuchatel (CH)

(72) Inventor: Cristina Apetrei Birza, Orbe (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 38 days.

(21) Appl. No.: 15/768,850

(22) PCT Filed: Oct. 21, 2016

(86) PCT No.: PCT/EP2016/075312
§ 371 (c)(1),
(2) Date: Apr. 17, 2018

(87) PCT Pub. No.: WO2017/068096
PCT Pub. Date: Apr. 27, 2017

(65) Prior Publication Data

US 2019/0053535 A1 Feb. 21, 2019

(30) Foreign Application Priority Data

Oct. 22, 2015 (EP) ..... 15190938

(51) Int. Cl.
*A24F 47/00* (2020.01)
*A24D 1/14* (2006.01)
(Continued)

(52) U.S. Cl.
CPC ..... *A24D 1/14* (2013.01); *A24B 15/167* (2016.11); *A24D 1/002* (2013.01); *A24F 7/00* (2013.01);
(Continued)

(58) Field of Classification Search
CPC ..... A24F 40/465
See application file for complete search history.

(56) References Cited

U.S. PATENT DOCUMENTS 5,613,505 A * 3/1997 Campbell ..... A24F 47/008 131/194
8,393,331 B2 3/2013 Hon
(Continued)

FOREIGN PATENT DOCUMENTS

CN 1126426 C 10/2003
CN 101951796 A 1/2011
(Continued)

OTHER PUBLICATIONS

PCT Search Report and Written Opinion for PCT/EP2016/075312 dated Feb. 17, 2017 (12 pages).
(Continued)

*Primary Examiner* — Eric Yaary
(74) *Attorney, Agent, or Firm* — Oblon, McClelland, Maier & Neustadt, L.L.P.

(57) ABSTRACT

A capsule for use in an aerosol-generating system includes a shell including a base and at least one side wall extending from the base. The capsule further includes a lid sealed on the at least one side wall for forming a sealed capsule. The shell contains an aerosol-forming substrate and susceptor material for heating the aerosol-forming substrate in the shell.

20 Claims, 2 Drawing Sheets

(51) Int. Cl.

| | |
|---|---|
| ***A24B 15/167*** | (2020.01) |
| ***A24D 1/00*** | (2020.01) |
| ***A24F 7/00*** | (2006.01) |
| ***B65D 85/804*** | (2006.01) |

(52) U.S. Cl.
CPC ..... *A24F 47/008* (2013.01); *B65D 85/804* (2013.01)

(56) References Cited

U.S. PATENT DOCUMENTS

| | | | | |
|---|---|---|---|---|
| 2013/0160780 | A1* | 6/2013 | Matsumoto | B65B 1/20 131/329 |
| 2015/0040925 | A1 | 2/2015 | Saleem et al. | |
| 2015/0245669 | A1 | 9/2015 | Cadieux | |
| 2016/0100624 | A1* | 4/2016 | Yilmaz | A24D 1/14 131/367 |
| 2017/0055574 | A1* | 3/2017 | Kaufman | A24F 47/008 |
| 2017/0055580 | A1* | 3/2017 | Blandino | H05B 6/108 |
| 2017/0055584 | A1* | 3/2017 | Blandino | H05B 6/36 |
| 2017/0246407 | A1 | 8/2017 | Matsumoto et al. | |
| 2018/0343920 | A1* | 12/2018 | Sutton | B65B 11/52 |

FOREIGN PATENT DOCUMENTS

| | | | |
|---|---|---|---|
| CN | 203762288 | U | 8/2014 |
| CN | 104664608 | A | 6/2015 |
| CN | 107105776 | A | 8/2017 |
| CN | 107920601 | A | 4/2018 |
| EA | 9116 | | 10/2007 |
| EP | 2444112 | | 11/1987 |
| GB | 2504732 | | 1/2015 |
| JP | 2015-513922 | A | 5/2015 |
| RU | 132318 | | 9/2013 |
| WO | WO 2009/079641 | | 6/2009 |
| WO | 2012/026481 | A1 | 3/2012 |
| WO | WO 2014/048745 | | 4/2014 |
| WO | WO 2015/101479 | A1 | 7/2015 |
| WO | WO 2015/177043 | | 11/2015 |
| WO | WO 2015/198015 | | 12/2015 |
| WO | WO 2017/036957 | | 3/2017 |

OTHER PUBLICATIONS

Office Action issued in Russia for Application No. 2018118556 dated Feb. 17, 2020 (11 pages). English translation included.

Office Action issued in Europe for Application No. 16787779.4 dated Nov. 27, 2019 (4 pages).

Combined Chinese Office Action and Search Report dated Jun. 11, 2020, in Patent Application No. 201680060368.4 (with English translation), 36 pages.

Notice of Reasons for Refusal dated Nov. 30, 2020 in corresponding Japanese Patent Application No. 2018-517556 (with English machine translation)(8 pages).

* cited by examiner

AEROSOL-GENERATING SYSTEM AND CAPSULE FOR USE IN AN AEROSOL-GENERATING SYSTEM

This application is a U.S. National Stage Application of International Application No. PCT/EP2016/075312, filed Oct. 21, 2016, which was published in English on Apr. 27, 2017, as International Publication No. WO 2017/068096 A1. International Application No. PCT/EP2016/075312 claims priority to European Application No. 15190938.9 filed Oct. 22, 2015.

The invention relates to a capsule for use in an aerosol-generating system and an aerosol-generating system.

BACKGROUND

Aerosol-generating systems comprising capsules are known. One particular system is disclosed in the international patent publication WO 2009/079641. The system comprises a capsule comprising a shell containing viscous vaporisable material. The shell is sealed by a lid which can be penetrated when the capsule is inserted in an aerosol-generating device comprised in the system, to allow airflow through the capsule when in use. The device comprises a heater configured to heat the external surface of the shell to a temperature up to about 200 degree Celsius. In such systems, the heater is close to the external wall of the device. This may lead to high external temperatures, which may be uncomfortable for a user holding the device. In addition, the time to first puff of the device has been found to be up to 30 seconds or longer. Thus, the known capsule heating aerosol-generating system presents a number of problems. It is therefore an object of the present invention to ameliorate those problems and provide a capsule for an aerosol-generating system and an aerosol-generating system that improves heating efficiency.

BRIEF SUMMARY

According to an aspect of the present invention, there is provided a capsule for use in an aerosol-generating system, preferably for use in a portable system, in particular for use in a hand-held system. The capsule comprises a shell comprising a base and at least one side wall extending from the base. The capsule further comprises a lid sealed on the at least one side wall for forming a sealed capsule. The shell contains an aerosol-forming substrate and susceptor material for heating the aerosol-forming substrate in the shell. In this respect, the shell contains susceptor material and the shell contains aerosol-forming substrate is understood in that aerosol-forming substrate and susceptor material are arranged in the shell of the capsule.

Providing aerosol-forming substrate and susceptor material in the capsule allows to very directly heat the aerosol-forming substrate. Heat is generated directly at the location of the aerosol-forming substrate, namely within the capsule. Thus, a total amount of substrate may be reduced due to an efficient use of the substrate. As a consequence, waste of material and cost may be reduced. In addition, overheating of the aerosol-forming substrate may be prevented and thus combustion of the substrate and combustion products formed may be reduced or prevented.

Power requirements are reduced, possibly reducing the maximum temperature usually required at a heater for heating a capsule to provide a minimum temperature to the aerosol-forming substrate in the capsule.

The improved heat management may also lead to a faster heating-up of the aerosol-forming substrate and thus to shorter start-up times and less energy required for a device to get ready for use. Heat loss is reduced and the amount of heating energy may be reduced, which may in particular be advantageous in view of longer operation time of a device or in view of battery capacity or battery size of an electronic heating device.

Heating the substrate inside of the capsule also reduces an increase of external temperatures of an aerosol-generating device, in particular a portable hand-held device. This may improve a user experience, while possibly also enabling an increase in the operating temperature. The latter may provide more flexibility in materials suitable for forming aerosol.

The aerosol-forming substrate is preferably a substrate capable of releasing volatile compounds that can form an aerosol. The volatile compounds are released by heating the aerosol-forming substrate.

The aerosol-forming substrate may be solid or liquid or comprise both solid and liquid components. In a preferred embodiment, the aerosol-forming substrate is solid.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavour compounds, which are released from the aerosol-forming substrate upon heating. The aerosol-forming substrate may comprise homogenised tobacco material.

Homogenised tobacco material may be formed by agglomerating particulate tobacco. Where present, the homogenised tobacco material may have an aerosol-former content of equal to or greater than 5% on a dry weight basis, and preferably between 5% and 30% by weight on a dry weight basis. The aerosol-forming substrate may alternatively comprise a non-tobacco-containing material. The aerosol-forming substrate may comprise homogenised plant-based material.

The aerosol-forming substrate may comprise at least one aerosol-former. The aerosol former may be any suitable known compound or mixture of compounds that, in use, facilitates formation of a dense and stable aerosol and that is substantially resistant to thermal degradation at the operating temperature of an aerosol-generating device.

The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

Suitable aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

The improved efficiency and very direct heating of the aerosol-forming substrate enables a higher operating temperature. The higher operating temperature enables, for example, glycerine to be used as an aerosol-former which provides an improved aerosol as compared to the aerosol-formers used in the known systems.

The aerosol-forming substrate may comprise other additives and ingredients, such as nicotine or flavourants.

The aerosol-forming substrate preferably comprises nicotine and at least one aerosol former.

As used herein, the term 'susceptor' refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol-forming substrate, the substrate is heated by the susceptor such that an aerosol is formed. Preferably, the susceptor is arranged in direct physical contact with the aerosol-forming substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example ferritic iron, a ferromagnetic alloy, such as ferromagnetic steel or stainless steel, ferromagnetic particles, and ferrite. A suitable susceptor may be, or comprise, aluminium.

Preferred susceptors are metal susceptors, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

A susceptor preferably comprises more than 5%, preferably more than 20%, preferably more than 50% or 90% of ferromagnetic or paramagnetic materials. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core.

A susceptor may be solid, hollow or porous. Preferably, a susceptor is solid.

A susceptor may be a carrier for a liquid aerosol-forming substrate. For example, liquid aerosol-forming substrate may be loaded onto or in the susceptor. For example, a susceptor may be a sponge-like material, for example, a metallic sponge.

A susceptor may basically have any form or profile. If a susceptor has a profile of constant cross-section, for example a circular cross-section, it has a preferable width or diameter of between 1 millimeter and 5 millimeter. If the susceptor profile has the form of a sheet or band, the sheet or band preferably has a rectangular shape having a width preferably between 2 millimeter and 8 millimeter, more preferably, between 3 millimeter and 5 millimeter, for example 4 millimeter and a thickness preferably between 0.03 millimeter and 0.15 millimeter, more preferably between 0.05 millimeter and 0.09 millimeter, for example 0.07 millimeter.

If the susceptor is in the form of a plurality of particles distributed, preferably homogeneously, in the aerosol-forming substrate, the susceptor particles are typically in the form of susceptor powder and may have sizes in a range of 5 micrometer to 100 micrometer, more preferably in a range of 10 micrometer to 80 micrometer, for example may have sizes between 20 micrometer and 50 micrometer.

Preferably, the susceptor material is in the form of strip, rod, filament, particle, crimped or folded sheet or mesh. Several strips, rods, filaments or particles or portions of sheets or meshes may be contained in the capsule.

Preferably, the aerosol-forming substrate is in the form of particle, strip, crimped or folded sheet, pellet or viscous material. Several particles or strips may be contained in the shell of the capsule. A pellet may be compacted or compressed individual aerosol-forming substrate pieces, for example a compressed plurality of particles or strips.

Aerosol-forming substrate and susceptor material may be loosely arranged in the shell. For example strips or beads of susceptor material may be loosely arranged between aerosol-forming substrate. The susceptor material may also be fixed in its position, for example by compression of aerosol-forming substrate and susceptor material.

The susceptor material may be embedded in or coated by aerosol-forming substrate, for example during the manufacturing process of the aerosol-forming substrate. For example, susceptor particles may be introduced into an aerosol-forming slurry or a susceptor material may be coated with aerosol-forming slurry.

The aerosol-forming substrate may, for example, be in the form of particles, for example granules or beads, comprising a susceptor core coated with aerosol-forming substrate. Such particles preferably have a maximum size of 6 millimeter, more preferably a maximum size of 4 millimeter, even more preferably a maximum size of 2 millimeter. The aerosol-forming substrate may, for example, be in the form of a sheet comprising a susceptor material coated with aerosol-forming substrate. In such embodiments, the susceptor advantageously is in the form of a sheet, for example, a foil, mesh or web, coated with aerosol-forming substrate.

A sheet of aerosol-forming substrate, including or excluding susceptor material, may be crimped, folded or may, for example, be cut into strips and subsequently inserted into the shell before sealing the shell.

If the susceptor is in the form of a plurality of particles coated with aerosol-forming substrate, the susceptor particles, for example, such as beads or grit, may be between 0.2 mm and 2.4 mm, preferably between 0.2 mm and 1.7 mm, more preferably between 0.3 mm and 1.2 mm. Susceptor particles to be coated, such as flakes may have a maximal length of between 0.2 mm and 4.5 mm, preferably between 0.4 mm and 3 mm, more preferably between 0.5 mm and 2 mm. A thickness of susceptor flakes may be between 0.02 mm and 1.8 mm, preferably between 0.05 mm and 0.7 mm, more preferably between 0.05 mm and 0.3 mm.

A sheet of aerosol-forming substrate, for example comprising tobacco material and an aerosol former may have a thickness between 0.1 millimeter and 2 millimeter, preferably between 0.3 millimeter and 1.5 millimeter, for example, 0.8 millimeter. The sheet of aerosol-forming substrate may have deviations in thickness of up to about 30 percent due to manufacturing tolerances.

An aerosol-forming substrate sheet, in particular a homogenised tobacco material sheet may, for example, be shredded or cut into strips having a width of between 0.2 mm and 2 mm, more preferably between 0.4 mm and 1.2 mm. The width of the strips may, for example, be 0.9 mm.

Alternatively, aerosol-forming substrate, in particular homogenised tobacco material, may be formed into spheres, using spheronization. The mean diameter of the spheres is preferably between 0.5 mm and 4 mm, more preferably between 0.8 mm and 3 mm.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

The aerosol-forming substrate and susceptor material may be filled into the shell by known filling means. The aerosol-forming substrate and susceptor material may also be pre-filled into a sachet, which sachet is then inserted into the shell.

Thus, a capsule may comprise a sachet arranged in the shell. The sachet comprises a porous container, wherein the aerosol-forming substrate and the susceptor material is contained.

The sachet is preferably formed from a mesh. The mesh is preferably porous to the generated aerosol, and enables the aerosol to be released from the sachet. The mesh may be formed by any suitable process, such as for example weaving the material, or by cutting using a toothed roller or the like, and then expanding the material by providing a force perpendicular to the axis of the toothed rollers.

The sachet may be formed from any suitable material which is capable of resisting the high temperature during use, without combusting or imparting undesirable flavours into the aerosol. In particular, the natural fibres sisal and ramie are particularly appropriate for forming the sachet. Alternatively, the sachet may be formed from ceramic fibres or metal.

The material used to form the sachet may be between 50 micrometer and 300 micrometer in thickness. Providing a sachet using thin material may reduce material costs and waste. Thicker sachet material may, depending on the material used for the sachet, enhance an insulating effect the sachet may provide between the heated susceptor material and aerosol-forming substrate within the sachet and the outside of the capsule. A fibre size of the material used to form the sachet may be between 10 micrometer and 30 micrometer.

The aerosol-forming substrate and susceptor material within the container preferably have a porosity of between 0.2 and 0.35. More preferably, the porosity is between 0.24 and 0.35. The porosity is defined as the volume fraction of void space within the container. Thus, a porosity of 100 percent would mean that the container comprised no substrate and no susceptor material, and a porosity of 0 percent would mean that the container was completely full of substrate and susceptor without any voids.

The capsule may entirely or only partially be filled with aerosol-forming substrate and susceptor material. A filling level may be chosen and adapted to a particular user experience or corresponding to a predefined number of puffs.

The capsule is preferably filled with between 150 mg and 400 mg of aerosol-forming substrate, more preferably between 200 mg and 300 mg of aerosol-forming substrate, and in a preferred embodiment with 250 mg of aerosol-forming substrate.

Preferably, a ratio of susceptor material to aerosol-forming substrate is optimized for a specific consuming experience or aerosolization profile. A ratio of an amount of susceptor material to an amount of aerosol-forming substrate may be varied. However, preferably such a ratio is fixed within a certain range.

A ratio of an amount of susceptor material to an amount of aerosol-forming substrate may, for example be 1:1 to 1:4, preferably 1:1.5 to 1:2.5. The ratios are considered volumetric ratios.

Ratios in this range are favorable with respect to efficient and preferably homogenous heating of the aerosol-forming substrate and aerosol-production. The ratio may be configured such that heating is performed in a manner to provide a consistent substance delivery, preferably nicotine delivery to a user.

As described above, the aerosol-forming substrate may be liquid. In such embodiments, the capsule may be provided with a high liquid retention material to substantially prevent leakage of the liquid aerosol-forming substrate from the capsule when in use. The high liquid retention material may be a sponge-like material. For example, the high retention material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

A retention material may, for example, also be a susceptor, for example made of a sponge-like material.

The capsule may be manufactured using any suitable method. For example, the shell may be manufactured using a deep drawing or molding process. The aerosol-forming substrate may then be filled into the shell using any other suitable means. The shell is then sealed with the lid. The lid may be sealed to the shell of the capsule using any suitable method, including: adhesive, such as an epoxy adhesive, heat sealing, ultrasonic welding, and laser welding.

Preferably, the lid is frangible. A frangible lid may be pierced or perforated by any suitable piercing member, for example, of an aerosol-generating device, when in use to enable an airflow through the capsule.

The lid is preferably made from a polymer or a metal or may comprise metal. The lid may be laminated to improve the sealing ability. Preferably, the lid is made of a laminated, food grade, metal.

Preferably, the capsule including shell and lid are formed of a material comprising no, or a limited amount of ferromagnetic or paramagnetic material. In particular, the capsule, shell and lid, may comprise less than 20 percent, in particular less than 10 percent or less than 5 percent or less than 2 percent of ferromagnetic or paramagnetic material.

As used herein, the term "longitudinal" refers to the direction between the proximal, or lid, end and opposed distal, or base, end of the capsule, and refers to the direction between the proximal, or mouthpiece end and the distal end of an aerosol-generating device comprised in the system according to the invention.

The base of the shell is preferably substantially circular. The radius of the base of the capsule is preferably between 3 mm and 6 mm, more preferably between 4 mm and 5 mm, and in a particularly preferred embodiment the radius of the base is 4.5 mm.

The longitudinal length of the at least one side wall is preferably at least 2 times the radius of the base. Advantageously, a shell having such dimensions may provide sufficient volume within the capsule to contain enough aerosol-forming substrate and susceptor material to provide the user with a good user experience.

The longitudinal length of the capsule is preferably between 7 mm and 13 mm, more preferably between 9 mm and 11 mm, and in a particularly preferred embodiment the longitudinal length of the capsule is 10.2 mm.

The shell preferably has a wall thickness of between 0.1 mm and 0.5 mm, more preferably between 0.2 mm and 0.4 mm, and in a particularly preferred embodiment, the wall thickness of the shell is 0.3 mm.

Providing a thin walled shell may reduce material cost and waste upon disposal of the capsule.

The shell is preferably integrally formed. The material used to form the shell may be metal. Alternatively, the material used to form the shell may be polymeric, such as any suitable polymer capable of withstanding the operating temperature of the susceptor material. The capsule may comprise or be made of thermally insulating material.

The capsule or parts of the capsule may be formed from one or more suitable materials. Suitable materials include, but are not limited to, polyether ether ketone (PEEK), polyimides, such as Kapton®, polyethylene terephthalate (PET), polyethylene (PE), polypropylene (PP), polystyrene (PS), fluorinated ethylene propylene (FEP), polytetrafluoroethylene (PTFE), epoxy resins, polyurethane resins, vinyl resins, metals such as, for example, stainless steel, paper or cardboard.

Suitable materials may be food-safe materials, such as for example FDA approved materials for medical tools and devices.

The capsule, shell and lid may be formed from one or more materials that are resistant to ingredients of the aerosol-forming substrate, for example nicotine-resistant or aerosol-former-resistant and resistant to the susceptor material comprised in the capsule.

The capsule, shell and lid may be coated with one or more resistant materials, resistant to ingredients of the aerosol-forming substrate and resistant to the susceptor material comprised in the capsule.

According to another aspect of the invention, there is provided an aerosol-generating system, preferably a portable system, in particular a hand-held system. The aerosol-generating system comprises a capsule comprising a shell comprising a base and at least one side wall extending from the base. The capsule further comprises a lid sealed on the at least one side wall for forming a sealed capsule. The shell contains an aerosol-forming substrate and susceptor material for heating the aerosol-forming substrate in the shell. Preferably, the system comprises a capsule according to the invention and as described herein.

The system further comprises a power source connected to a load network. The load network comprises an inductor for being inductively coupled to the susceptor material within the shell.

The inductor may comprise one or more coils that generate a fluctuating electromagnetic field to be inductively coupled to the susceptor material in a capsule. The coil or coils may surround a capsule receiving cavity of an aerosol-generating device, in which cavity the capsule in arranged in use of the system. Preferably, the inductor is part of a device housing. For example, one or several induction coils may in a very space saving manner be embedded in the device housing.

When actuated, a high-frequency alternating current is passed through coils of wire that form part of the inductor. When a capsule is correctly located in the capsule receiving cavity, the susceptor material in the capsule is located within this fluctuating electromagnetic field. The fluctuating field generates eddy currents or hysteresis losses within the susceptor material, which is heated as a result. The heated susceptor material heats the aerosol-forming substrate to a sufficient temperature to form an aerosol, for example to about 180 to 220 degree Celsius.

The aerosol is drawn out of the capsule downstream through a mouthpiece to exit the aerosol-generating device by the mouthpiece.

Preferably, the load network of the aerosol-generating system according to the invention comprises a single induction coil. This advantageously provides for a simple device construction and device electronics and operation. In addition, aerosol-generating devices for use with capsules may be adapted to inductive heating. Such devices may, for example, be provided with an electronics and load network including an inductor. Thus, such devices may be manufactured, requiring less power than conventionally heated devices, for example comprising Kapton® heaters, and providing all advantages of contactless heating (for example, no tight fit of capsule within cavity required allowing large manufacturing tolerances, electronics separated from heating element).

The aerosol-generating system may comprise a thermal insulation layer at least partially surrounding the aerosol-forming substrate and the susceptor material comprised in the capsule. The thermal insulation layer may, for example, at least partially be arranged around the capsule. Preferably, a thermal insulation layer may be arranged to extend around the at least one side wall and the base of the shell.

Since the shell of the capsule is not needed for heat contact and heat transfer from a heater to the content of the capsule the thermal insulation layer may be incorporated into the shell of the capsule. For example, the shell may at least partially be made of or contain a thermally insulating material. In such embodiments, advantageously, the shell is entirely made of a thermally insulating material. Thus, the thermal insulation layer is a material layer separate to or integrated into the capsule.

Preferably, the thermal insulation layer is arranged in the device the capsule is used with, preferably at least partially surrounding the capsule receiving cavity of the device. Thus, thermal insulation is provided in the device independently of a design of a capsule used with the device. Through a thermal insulation, heat generated in the capsule is kept in the capsule. Less or no heat loss through heat conduction to the environment is available. In addition, a heating up of a housing of an aerosol-generating device may be limited or avoided.

A thermal insulation layer may be arranged in a device housing, for example between inductor and capsule. It may also be arranged outside of the inductor, for example, at least partially surrounding the inductor.

Advantageously, a thermal insulation layer is arranged at least partly between the at least one side wall of the shell and the inductor. By this, heat generated in the capsule and possibly conducted through the shell side wall is prevented to proceed further to the outside. In particular, heat is prevented or limited to be conducted radially to a device housing, thus preventing the heating up of further device parts, in particular an external side of a device housing which is touched by a user.

Since no external heater, such as a Kapton® heater is required in the aerosol-generating system according to the invention, space needed in known aerosol-generating devices for such heaters may either be saved in a device used in the system according to the invention or may be used for thermal insulation without requiring extra space.

Thermal conductivity is the property of a material to conduct heat. Heat transfer occurs at a lower rate across materials of low thermal conductivity than across materials of high thermal conductivity. The thermal conductivity of a material may depend on temperature.

Thermally insulating materials as used in the present invention for a thermal insulation, in particular for a shell or further capsule parts, preferably have thermal conductivities of less than 1 Watt per (meter×Kelvin), preferably less than 0.1 Watt per (meter×Kelvin), for example between 1 and 0.01 Watt per (meter×Kelvin).

The aerosol-generating device comprised in the system according to the invention may comprise a piercing member. The piercing member is configured to rupture, for example pierce or perforate, the lid of the capsule.

The aerosol-generating device may comprise a mouthpiece preferably comprising at least one air inlet and at least one air outlet. The piercing member preferably comprises at least one first conduit extending between the at least one air inlet and a distal end of the piercing element.

The mouthpiece preferably further comprises at least one second conduit extending between the distal end of the piercing element and the at least one air outlet. The mouthpiece is therefore preferably arranged, such that, in use, when a user draws on the mouthpiece, air flows along an airflow pathway extending from the at least one air inlet, through the at least one first conduit, through a portion of the capsule, through the at least one second conduit and exits the at least one outlet.

Providing such conduits enables improved airflow through the device and enables the aerosol to be delivered to a user more easily.

BRIEF DESCRIPTION OF THE DRAWINGS

The invention is further described with regard to embodiments, which are illustrated by means of the following drawings, wherein.

DETAILED DESCRIPTION

Figure 1:
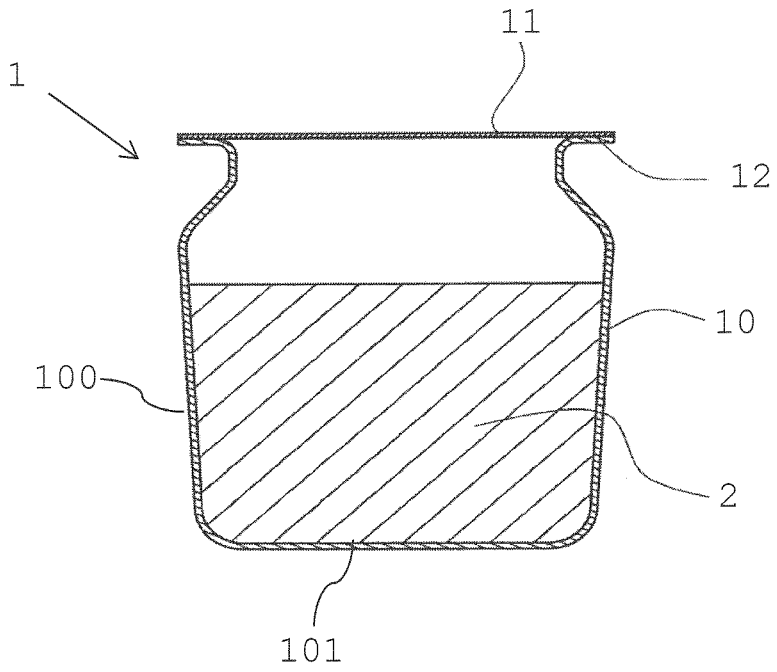
FIG. 1 shows an example of a capsule.

FIG. 1 shows a capsule 1 containing an active substrate 2 comprising an aerosol-forming substrate and susceptor material for use with a device capable of inductively heat the susceptor material of the active substrate 2 and capable of vaporizing the aerosol-forming substrate. The capsule 1 contains a shell 10 that is sealed with a lid 11. The shell 10 comprises a flange 12 for adhering the lid 11 to the shell 10. The shell 10 comprises a base 101 and a side wall 100. The shell 10 of the capsule 1 or the entire capsule 1 may be made from a variety of materials including, but not limited to, metals, rigid plastics, flexible plastics, paper, paperboard, cardboard, and wax paper. Preferably, the shell and also the lid 11 is formed of a material comprising no, or a limited amount of ferromagnetic material or paramagnetic material. In particular, the shell and lid may comprise less than 20 percent, in particular less than 10 percent or less than 5 percent or less than 2 percent of ferromagnetic or paramagnetic material.

The shell 10 of the capsule 1 typically comprises a food-safe material, as in most cases, the capsule 1 is to be used with a device for inhalation of an aerosol generated be vaporizing the aerosol-forming substrate. Examples of some food-safe materials include polyethylene terephthalate (PET), amorphous polyethylene terephthalate (APET), high density polyethylene (HDPE), polyvinyl chloride (PVC), low density polyethylene (LDPE), polypropylene, polystyrene, polycarbonate, and many varieties of paper products. In some cases, especially when the material is paper, the shell 10 can be lined with a material or a food-safe material to prevent both drying of the aerosol-forming substrate and to protect the active substrate 2.

A shell 10 of a capsule 1 can be lidded with, for example a heat-sealable lidding film, to make a fully enclosed and airtight capsule 1. A sealed capsule may have the advantage of preserving freshness of the contents, and preventing spill of the active material within the capsule 1 during transport or handling by a user.

Preferably, a capsule 1 is formed and shaped for easy insertion into a cavity of an inductive heating device and to preferably snugly fit into the cavity of the device, for example a device according to the invention and as described herein.

The lid 11 of a capsule 1 may also be made by a variety of materials. Typically, the lid comprises a food-safe material. The lid 11 can be sealed onto the capsule 1 after the active substrate 2 has been filled into the capsule 1. Many methods of sealing the lid 11 upon the shell 10 of a capsule 1 are known to those skilled in the art. One example of a method of sealing the lid on a shell of a capsule comprising a flange 12 is heat sealing. Preferably, the lid 11 of the capsule 1 is considered food-safe to at least about 350 degree Celsius. The lid 11 can be a commercially-available film for use with foods cooked in a conventional oven, and are often referred to as dual-ovenable (for microwave and conventional oven use). The dual-ovenable films typically comprise a PET (polyethylene terephthalate) base layer and an APET (amorphous polyethylene terephthalate) heat-sealing layer. The APET heat-sealing layer then comes in contact with the flange 12 of the shell 10 of the capsule 1. Such lidding films can readily be metallized, or foilized in advance to improve the barrier performance of the film regarding moisture, oxygen and other gases.

The material of a capsule 1, in particular the shell 10, can serve to preserve the freshness of the content, and increase shelf life of the capsule. A capsule or lid or shell may also improve the visual appeal and perceived value of a capsule 1. The material of the capsule can also allow for improved printing and visibility of product information such as brand and indication of flavour.

A capsule 1 may have apertures or vents (not shown) in the capsule. These apertures may allow for the content within the capsule 1 to have access to the environment. The capsule 1 may also be composed of a material, or preferably comprise a lid that can be punctured or opened when put into a device capable of vaporizing the contents of the capsule 1. For example, if a capsule 1 is heated to a certain temperature, the contents vaporize, and the aperture or apertures created by the device allow the vapour content from the heated capsule 1 to escape. The capsule 1 may also comprise a lid 11 or a seal that can be opened, for example peeled of, immediately prior to the capsule 1 being inserted within a device.

Preferably, the capsule 1 is intended for a single use and may be replaced by a new one after use. The type of product contained within the capsule 1 may be marked on the capsule, may be indicated by the colour, size, or shape of the capsule 1.

Any material that is capable of being aerosolized and inhaled by a user may be used in a device or capsule 1 according to the invention. Such materials may include, but are not limited to those containing tobacco, natural or artificial flavourants, coffee grounds or coffee beans, mint, chamomile, lemon, honey, tea leaves, cocoa, and other non-tobacco alternatives based on other botanicals. Compounds may be used, which can be vaporized (or volatized) at a relatively low temperature and preferably without harmful degradation products. Examples of compounds include, but are not limited to, menthol, caffeine, taurine, and nicotine.

Preferably, tobacco or tobacco material is filled into the capsule 1. Here, tobacco or tobacco material is defined as any combination of natural and synthetic material comprising tobacco. A capsule can be prepared using cured tobacco, an aerosol-former such as glycerine or propylene glycol, flavourings and susceptor material. For example, tobacco may be chopped into fine pieces (for example, less than 2 millimeter diameter, preferably less than 1 millimeter), adding the other ingredients, and mixing until even consistency is achieved. The active substrate may also be processed into a paste-like consistency, for example, with tobacco particle sizes less than 1 millimeter and susceptor material in the form of particles. Such a paste-like substrate or slurry may facilitate the processing of filling the capsule 1.

A tobacco containing slurry may also be spread and dried to form a sheet, so called cast leaf. The dried leaf may be inserted into the capsule in a crimped and folded form, while the susceptor material may be combined with the cast leaf either before or after insertion of the cast leaf into the capsule.

A tobacco sheet, for example a cast leaf, may have a preferred thickness in a range between about 0.5 millimeter and about 1.5 millimeter, for example 1 millimeter.

The cast leaf may also be processed, for example, by chopping the sheet into small pieces or strips, for example of 0.5 millimeter to 1.5 millimeter in width.

A tobacco slurry may also be directly spread onto a sheet of susceptor material such that after drying of the aerosol-forming substrate, the active substrate is formed by a susceptor sheet coated with aerosol-forming substrate. Such a sheet of active substrate may then be cut, gathered or folded and inserted into a capsule.

Volumes of active substrate comprise, for example, about 0.25 cubic centimetre active substrate per capsule 1.

Figure 2:
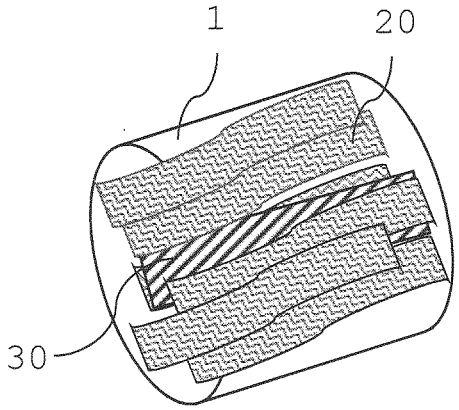
FIGS. 2 to 4 illustrate different inductively heatable capsule fillings.
Figure 3:
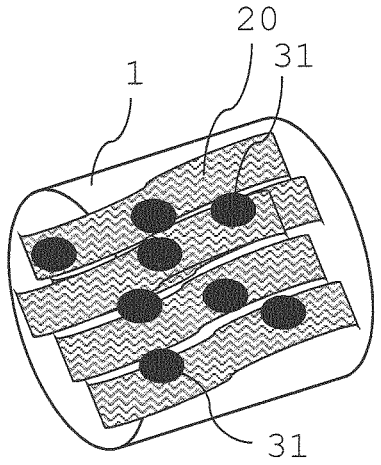
Figure 4:
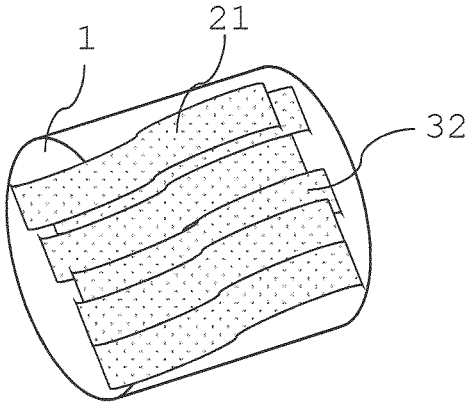

In FIG. 2 to FIG. 4 schematically drawn capsules 1 in tubular form are filed with different examples of active substrate.

In FIG. 2 several strips of aerosol-forming substrate 20 and a strip of susceptor material 30, for example, a strip of a stainless steel foil, are filled into the capsule 1. Depending on a desired ratio of aerosol-forming substrate and susceptor material, more than one strip of susceptor material may be provided. Depending on a desired consuming experience, amount of aerosol formed or puffs that shall be available with one capsule 2, the number of aerosol-forming substrate strips 20 may be enhanced or reduced. A strip of aerosol-forming substrate 20 may have a width, for example, of about 0.8 millimeter and 1 millimeter, while a strip length may, for example, be between 4 millimeter and 10 millimeter. Strip sizes for the susceptor material 30 may be about 2 to 4 millimeter in width with a same length as the strip of aerosol-forming substrate 20.

In FIG. 3 the capsule 1 is filled with a plurality of strips of aerosol-forming substrate 20. The susceptor material is provided in the form of a plurality of beads, for example ferromagnetic beads. The susceptor beads may have preferred diameters in a range between 0.3 millimeter and 2.5 millimeter.

In FIG. 4 the active substrate is provided in the form of strips 21 containing the susceptor material 32. The susceptor material is provided in the form of particles, which particles are embedded in the aerosol-forming substrate. The susceptor particles may have preferred sizes in a range between 20 micrometer and 50 micrometer.

Preferably, the susceptor particles are incorporated into the aerosol-forming substrate upon manufacturing of the active substrate. Such substrates may provide a very homogeneous and regular susceptor material distribution in the aerosol-forming substrate.

Active substrate 2 may also be provided in the form of a plurality of particles having a susceptor core and an aerosol-forming substrate coating.

Figure 6:
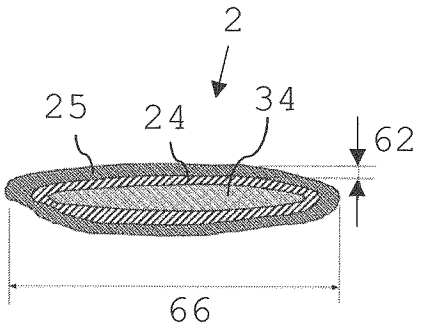
FIG. 6 shows cross sections of an inductively heatable flake with one of two coatings.
Figure 6:
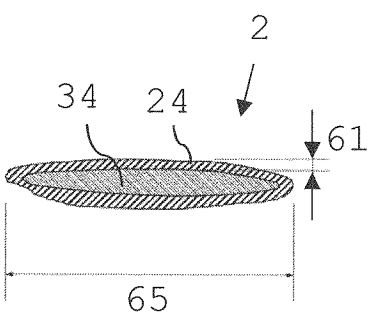
Figure 5:
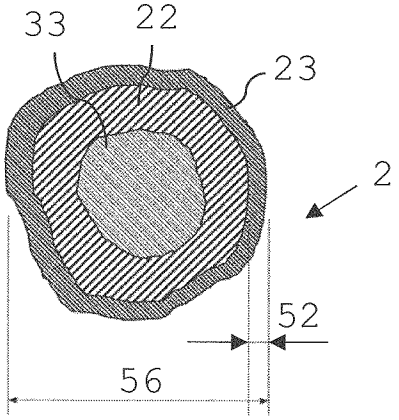
FIG. 5 shows cross sections of an inductively heatable bead with one of two coatings.
Figure 5:
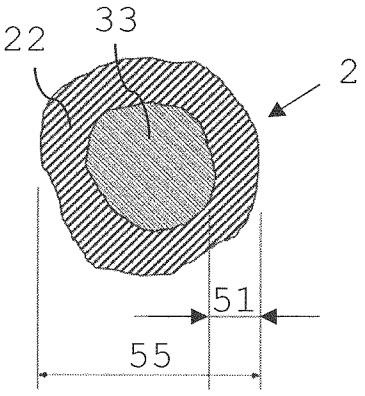

In FIG. 5 and FIG. 6 four examples of active substrate 2 particles in the form of beads (FIG. 5) and in the form of flakes (FIG. 6) are shown.

FIG. 5 shows a cross section of a susceptor core particle 33 in the form of a granule, which is coated with one or two aerosol-forming substrate coatings 22,23. Therein, a second coating 23 coats a first coating 22. The aerosol-forming substrate of the first coating 22 and of the second coating 23 may be the same or may be different, for example different in any one or a combination of composition, density, porosity, coating thickness.

The beads shown in FIG. 5 are inductively heatable and ready for being filled into a capsule 1 in a desired amount, for example, about a few tenths of beads up to a maximum of about 200 beads per capsule.

Preferably, the susceptor granule 33 is a metallic granule made of a metal or metal alloy, for example an austenitic or martensitic stainless steel. Preferably, the first and second aerosol-forming substrate coatings 22,23 are tobacco containing substrate coatings. In the embodiments shown in FIG. 5, the second coating 23 has about half the thickness of the first coating 22.

Sizes of particles, as well as of coatings may be determined by average circular diameter sizes. Susceptor granules, as well as the final beads 2 often do not have an exact round shape such that an average diameter 55,56 or an average coating thickness 51,52 is determined for the susceptor granules 33 and the final beads.

An average diameter for a susceptor granule 33 may be in a range between 0.1 millimeter and 4 millimeter, preferably between 0.3 millimeter and 2.5 millimeter.

An average thickness 51 for a first aerosol-forming substrate coating 22 may be in a range between 0.05 millimeter and 4.8 millimeter, preferably between 0.1 millimeter and 2.5 millimeter.

Thus, an average diameter 55 of a granule comprising one coating 22 of aerosol-forming substrate may be between 0.2 millimeter and a maximum of 6 millimeter, preferably between 0.5 millimeter and 4 millimeter.

An average thickness 52 for a second aerosol-forming substrate coating 23 may be in a range between 0.05 millimeter and 4 millimeter, preferably between 0.1 millimeter and 1.3 millimeter.

Thus, an average diameter 56 of a granule comprising two coatings 20,21 of aerosol-forming substrate may be between 0.3 millimeter and a maximum of 6 millimeter, preferably between 0.7 millimeter and 4 millimeter.

While a maximum particle size is 6 millimeter, preferably 4 millimeter, even more preferably 2 millimeter, an average diameter 55 of a particle having one substrate coating is typically smaller than an average diameter 56 of the particle having two substrate coatings.

When using a tobacco and aerosol-former containing slurry as aerosol-forming substrate coating, preferably a fluid bed granulation method is used for high volume production of particles. If low moisture slurry is used, preferably, powder granulation methods may be used for particle production. Preferably rotative coating granulators are used for the manufacture of beads.

FIG. 6 shows cross sections of a susceptor core particle in the form of a flake 34, which is coated with one or two aerosol-forming substrate coatings 24,25. The second coating 25 of aerosol-forming substrate coats the first coating 24. A plurality of the inductively heatable coated flakes as shown in FIG. 6 may be used in a capsule according to the invention.

A diameter of a susceptor flake 34 may be between 0.2 millimeter and 4.5 millimeter, preferably between 0.5 millimeter and 2 millimeter. A thickness of the susceptor flake 34 may be between 0.02 millimeter and 1.8 millimeter, preferably between 0.05 millimeter and 0.3 millimeter.

A thickness 61,62 for a first and a second aerosol-forming substrate coating 24,25 may be in the same ranges and in the same preferred ranges as the thicknesses for the above described coatings for beads.

Thus, a diameter of a flake coated with one aerosol-forming coating may be in a range between 0.3 millimeter and a maximum of 6 millimeter, preferably between 0.7 millimeter and 4 millimeter. A thickness of a flake coated with one aerosol-forming coating may be in a range between 0.12 millimeter and a maximum of 6 millimeter, preferably between 0.25 millimeter and 4 millimeter.

A diameter of a flake coated with two aerosol-forming coatings may be in a range between 0.4 millimeter and a maximum of 6 millimeter, preferably between 0.9 millimeter and 4 millimeter. A thickness of a flake 1 coated with two aerosol-forming coatings may be in a range between 0.22 millimeter and a maximum of 6 millimeter, preferably between 0.45 millimeter and 4 millimeter.

Figure 7:
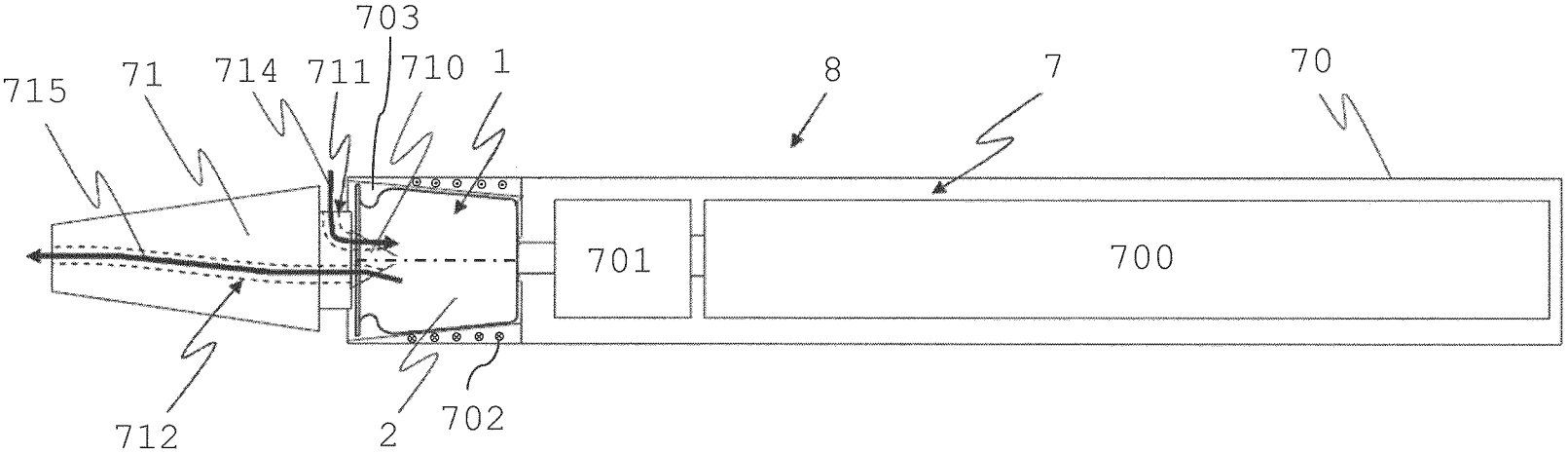
FIG. 7 schematically shows a cross-section of an inductively heatable aerosol-generating system.

FIG. 7 shows a cross-sectional view of an inductively heatable aerosol-generating system 8 comprising an aerosol-generating device 7 and a capsule 1 as described above. The aerosol-generating device 7 comprises an outer housing 70 adapted to house a power supply 700 such as a rechargeable battery, control electronics 701, and an inductor 702, for example a inductor coil. The housing 70 further comprises a cavity 703 wherein the capsule 1 is received. The inductor 702 is embedded in the proximal portion of the housing 70 surrounding the cavity 703 as well as the capsule 1 arranged in the cavity 703.

The aerosol-generating device 7 further comprises a mouthpiece 71 attachable to a proximal end of the device housing 70. The mouthpiece 71 comprises a piercing portion 710 directing versus the cavity 703. The mouthpiece 71 further comprises two airflow conduits arranged in the mouthpiece 71, an inlet conduit 711 and an outlet conduit 712.

When the capsule 1 is positioned in the cavity 703 of the housing 70, the susceptor material of the active substrate 2 contained in the capsule 1 is inductively heatable by the inductor coil 702.

In use, the user inserts the capsule 1 into the cavity 703 of the aerosol-generating device 7, and then attaches the mouthpiece 71 to the housing 70. By attaching the mouthpiece, the piercing portion 710 pierces the lid of the capsule 1, and forms an airflow pathway from the air inlet, through the capsule 1 to the air outlet. The portion of the airflow pathway 714 entering the capsule 1 and the portion of the airflow pathway 715 exiting the capsule 1 are indicated by arrows. The user then activates the device 7, for example by pressing a button (not shown). In activating the device, the inductor 702 is supplied with power by the control electronics 701 from the power supply 700. When the temperature of the content of the capsule 1 reaches an operating temperature of for example between about 180 degree Celsius and about 220 degree Celsius, the user may be informed by means of an indicator (not shown) that the device is ready for use and that the user may draw on the mouthpiece 71. When the user draws on the mouthpiece, air enters the air inlet, proceeds through the conduit 711 within the mouthpiece 71 and into the capsule 1, entrains vaporised aerosol-forming substrate, and then exits the capsule 1 via the outlet conduit 712 in the mouthpiece 71.

The invention claimed is:

1. An inductively heatable capsule for use in an aerosol-generating system, the capsule comprising:

a shell comprising a base and at least one side wall extending from the base; and a frangible lid sealed on the at least one side wall for forming a sealed capsule, the shell containing an aerosol-forming substrate and susceptor material for heating the aerosol-forming substrate in the shell, wherein the shell comprises thermally insulating material, wherein the aerosol-forming substrate and the susceptor material are loosely arranged in the capsule, and wherein a ratio of an amount of susceptor material to an amount of aerosol-forming substrate is 1:1 to 1:4.

2. The capsule of claim 1, wherein the susceptor material is in the form of strip, rod, filament, particle, crimped or folded sheet or mesh.

3. The capsule of claim 1, wherein the aerosol-forming substrate is in the form of particle, strip, crimped or folded sheet, pellet, viscous material.

4. The capsule of claim 1, wherein the aerosol-forming substrate comprises nicotine and an aerosol-former.

5. The capsule of claim 1, wherein the susceptor material is coated with the aerosol-forming substrate.

6. The capsule of claim 1, comprising a sachet arranged in the shell, the sachet comprising a porous container, wherein the aerosol-forming substrate and the susceptor material are contained in the porous container.

7. An inductively heatable aerosol-generating system comprising:

a capsule comprising a shell comprising a base and at least one side wall extending from the base, the capsule further comprising a frangible lid sealed on the at least one side wall for forming a sealed capsule, the shell containing an aerosol-forming substrate and susceptor material for heating the aerosol-forming substrate in the shell;

a thermal insulation layer at least partially surrounding the aerosol-forming substrate and the susceptor material comprised in the capsule;

a power source connected to a load network, the load network comprising an inductor for being inductively coupled to the susceptor material in the shell, and an aerosol-generating device comprising a mouthpiece and a piercing member for piercing the frangible lid of the capsule.

8. The system of claim 7, comprising an inductive heating and aerosol-generating device comprising the inductor and a device housing comprising a cavity for receiving the capsule.

9. The system of claim 8, wherein the device housing comprises the thermal insulation layer.

10. The system of claim 7, wherein the thermal insulation layer is arranged between the capsule and the inductor.

11. The system of claim 7, wherein the mouthpiece comprises at least one air inlet and at least one air outlet, and the piercing member comprises at least one first conduit extending between the at least one air inlet and a distal end of the piercing member, the mouthpiece further comprising at least one second conduit extending between the distal end of the piercing member and the at least one air outlet, such that in use, when a user draws on the mouthpiece, air flows along an airflow pathway extending from the at least one air inlet, through the at least one first conduit, through a portion of the capsule, through the at least one second conduit and exits the at least one outlet.

12. The system of claim 7, wherein a thermal conductivity of the thermal insulation layer is less than 1 Watt per (meter×Kelvin).

13. The system of claim 7, wherein the shell comprises thermally insulating material, and wherein the aerosol-forming substrate and the susceptor material are loosely arranged in the capsule, and wherein a ratio of an amount of susceptor material to an amount of aerosol-forming substrate is 1:1 to 1:4.

14. The capsule of claim 1, wherein the susceptor material is coated with two aerosol-forming substrate coatings, which two aerosol-forming substrate coatings differ in one or in a combination of composition, density, porosity, coating thickness.

15. The capsule of claim 1, wherein the capsule is an air-tight capsule.

16. The capsule of claim 1, wherein the porosity of the aerosol-forming substrate and susceptor material is between 0.2 and 0.35.

17. The capsule of claim 1, wherein the capsule is filled with an amount of aerosol-forming substrate between 150 mg and 400 mg.

18. The capsule of claim 1, wherein the shell comprises a flange for adhering the frangible lid to the shell.

19. The capsule of claim 18, wherein the flange is an outwardly directing flange.

20. The capsule of claim 1, wherein the shell comprises no paramagnetic or ferromagnetic material.

* * * * *